US009291438B2

(12) United States Patent
Item

(10) Patent No.: US 9,291,438 B2
(45) Date of Patent: Mar. 22, 2016

(54) CATAMARAN SURFACE VESSEL WITH REMOVABLE MISSION-SPECIFIC PAYLOAD MODULE

(71) Applicant: Raytheon Company, Waltham, MA (US)

(72) Inventor: Erik F. Item, W Barnstable, MA (US)

(73) Assignee: Raytheon Company, Waltham, MA (US)

( * ) Notice: Subject to any disclaimer, the term of this patent is extended or adjusted under 35 U.S.C. 154(b) by 81 days.

(21) Appl. No.: 14/090,955

(22) Filed: Nov. 26, 2013

(65) Prior Publication Data

US 2015/0144044 A1 May 28, 2015

(51) Int. Cl.

| | |
|---|---|
| ***B63B 35/40*** | (2006.01) |
| ***F42B 19/00*** | (2006.01) |
| ***F41F 3/10*** | (2006.01) |
| ***B63G 5/00*** | (2006.01) |
| *B63B 3/08* | (2006.01) |
| *B63B 35/00* | (2006.01) |

(52) U.S. Cl.

CPC . *F42B 19/00* (2013.01); *B63G 5/00* (2013.01); *F41F 3/10* (2013.01); *B63B 2003/085* (2013.01); *B63B 2035/006* (2013.01); *Y10T 29/49117* (2015.01); *Y10T 29/49716* (2015.01); *Y10T 29/49826* (2015.01)

(58) Field of Classification Search

USPC ..... 114/27, 259
IPC ..... B63B 27/36; F42B 19/00
See application file for complete search history.

(56) References Cited

U.S. PATENT DOCUMENTS

| | | | | |
|---|---|---|---|---|
| 4,176,885 | A * | 12/1979 | Alkema | 406/128 |
| 8,739,717 | B2 * | 6/2014 | Ellnor | 114/61.22 |
| 2004/0149196 | A1 * | 8/2004 | Schmidt et al. | 114/121 |
| 2014/0261127 | A1 * | 9/2014 | Heuton | 114/39.26 |

* cited by examiner

*Primary Examiner* — Stephen Avila

(57) ABSTRACT

A system includes a catamaran configured for use in a body of water and having twin hulls, the catamaran comprising an opening between the twin hulls, the opening having a size and shape substantially the same as a payload module. The system also includes the payload module removably coupled to the catamaran in the opening between the twin hulls. The system further includes a common interface coupled to the payload module and the catamaran, the common interface configured to exchange utilities between the payload module and the catamaran.

20 Claims, 4 Drawing Sheets

CATAMARAN SURFACE VESSEL WITH REMOVABLE MISSION-SPECIFIC PAYLOAD MODULE

TECHNICAL FIELD

The present disclosure is directed in general to maritime vessels and more specifically to a catamaran surface vessel with a removable mission-specific payload module.

BACKGROUND OF THE DISCLOSURE

A variety of maritime vessels are adaptable for multiple missions and purposes. However, it many cases, it is difficult, time-consuming, costly, or otherwise prohibitive to adapt a maritime vessel currently configured for one purpose or mission to be suitable for a second purpose or mission.

SUMMARY OF THE DISCLOSURE

To address one or more of the above-deficiencies of the prior art, one embodiment described in this disclosure provides a system that includes a catamaran configured for use in a body of water and having twin hulls, the catamaran comprising an opening between the twin hulls, the opening having a size and shape substantially the same as a payload module. The system also includes the payload module removably coupled to the catamaran in the opening between the twin hulls. The system further includes a common interface coupled to the payload module and the catamaran, the common interface configured to exchange utilities between the payload module and the catamaran.

Another embodiment in this disclosure provides a payload module for use with a catamaran. The payload module includes a connection point for a common interface configured to couple to a second connection point for the common interface on the catamaran, the common interface configured to exchange utilities between the payload module and the catamaran. The payload module is configured to be removably installed in an opening between twin hulls of the catamaran, the opening having a size and shape substantially the same as the payload module.

A further embodiment in this disclosure provides a method that includes loading a payload module into an opening in a catamaran. The method also includes coupling a first connection point for a common interface on the payload module to a second connection point for the common interface on the catamaran, the common interface configured to exchange utilities between the payload module and the catamaran. The catamaran is configured for use in a body of water and having twin hulls, the opening located between the twin hulls, the opening having a size and shape substantially the same as the payload module.

Other technical features may be readily apparent to one skilled in the an from the following figures, descriptions, and claims.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
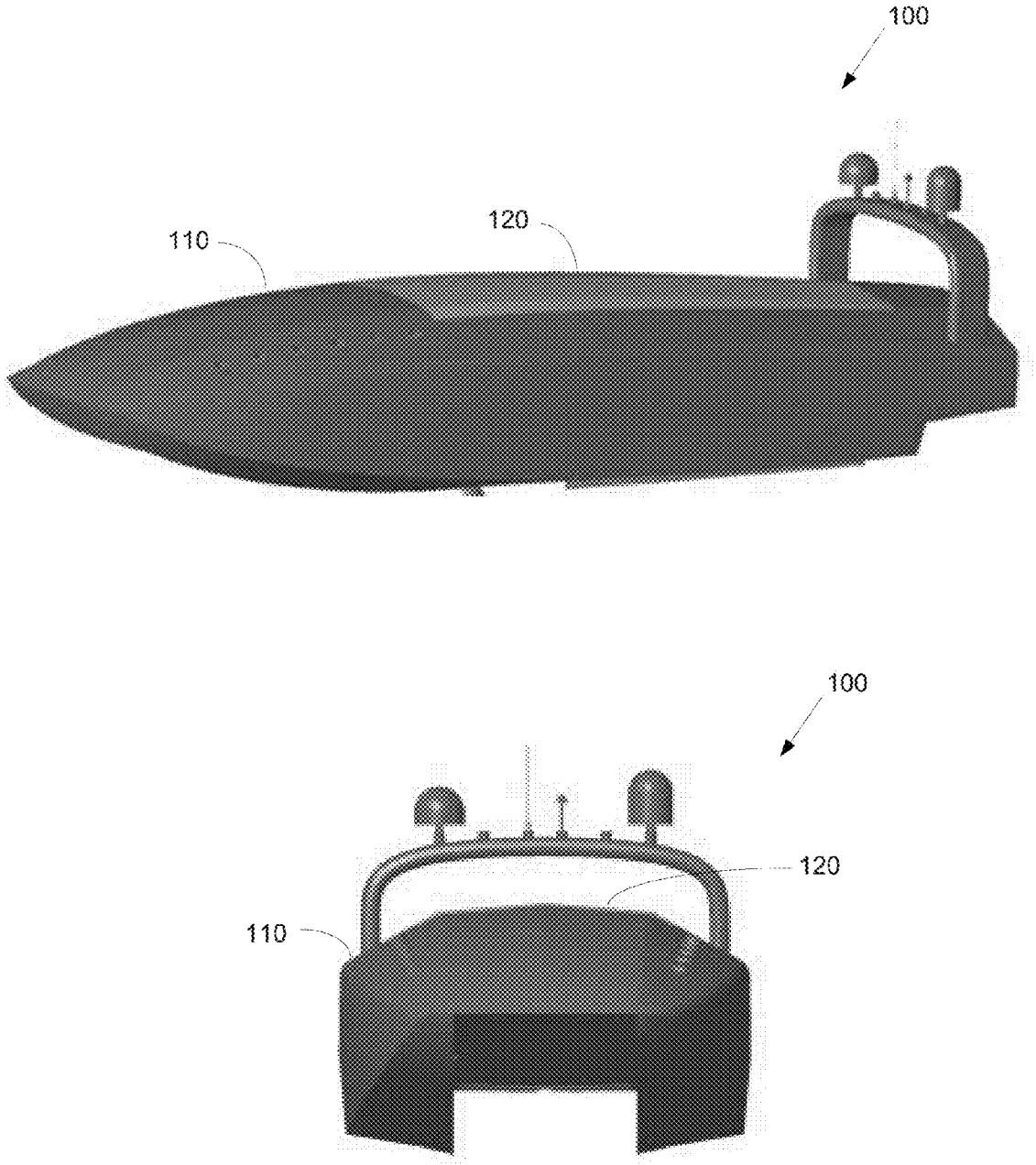
FIG. 1 illustrates front and side views of an unmanned surface vessel (USV) with a removable payload module, according to an embodiment of this disclosure.

FIGS. 1 through 4, described below, and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

Embodiments of this disclosure provide an unmanned surface vessel (USV) with a configurable, removable payload module. Such an USV may be used by military groups to support various types of maritime missions that require different equipment and technologies, including mine warfare and anti-submarine warfare missions. Other, non-military, commercial applications may include unmanned oil field inspections and harbor patrols and surveys. Such an USV enables lower-cost mission flexibility and higher performance across different missions.

Presently, some complex military missions require the use of multiple USVs. For example, a minefield clearance mission may require a first USV dedicated for mine hunting sonar, and a second, differently-equipped USV to be used as a mine neutralizer. Additional USVs may also be required for other mission objectives. These multiple different USVs take up significant deck space aboard a military vessel (e.g., a destroyer). Also, the different USVs may require different operational and maintenance routines, parts, and knowledge. Such a lack of flexibility in configuration among the different USVs results in greater pecuniary, personnel, and physical space costs to support the complex missions.

In contrast, the disclosed high-performance catamaran USV with a removable mission-specific payload module supports multiple payloads and multiple technologies. Thus, a maritime vessel could include a single catamaran USV and a plurality of modules, each configured for a different mission.

In various embodiments, the disclosed catamaran USV and payload module may include any one or more of the following features. The USV includes a high performance carbon fiber hull and foam cored catamaran design that includes a large removable center mission module that may hold equipment associated with any defined mission. The removable payload module is mounted into the hull structural frame, which allows the payload module to be removed quickly for rapid mission re-configuration. The payload module is configured with a common interface to the USV. The common interface may include power, data, air, hydraulic fuel, and other interfaces as required by the payload module.

According to particular configurations, the payload module includes an internal structure and common mounting interfaces to support equipment such as, but not limited to, towed sensor systems, torpedoes, cameras, unmanned undersea vehicles (UUVs), sonobuoys, dipping sonars, deployable sensors, deployable mission pods, surface-to-air missiles, module-mounted weapons, small-scale unmanned aerial vehicles (UAVs), and the like. The payload module may also include an opening cover, opening transom for stern deployment or lower opening doors for through-hull deployment of various payloads. The payload module may be vertically lifted for loading into the catamaran USV. The payload module may also be dropped out of the catamaran USV for deployment of large-sized payloads. In various embodiments, the standardized interface design of the payload module may be constructed of composite materials for ultra-lightweight applications or fabricated from standard aluminum or steel framed structures for cost and utilization of common fabrication techniques.

It will be understood that embodiments of this disclosure may include any one, more than one, or all of the features described above. In addition, embodiments of this disclosure may additionally or alternatively include other features not listed above.

FIG. 1 illustrates front and side views of an unmanned surface vessel (USV) with a removable payload module, according to an embodiment of this disclosure. The embodiment of the USV 100 illustrated in FIG. 1 is for illustration only. Other embodiments could be used without departing from the scope of this disclosure.

The USV 100 includes a twin hull catamaran 110 and the removable payload module 120. In an embodiment, the twin hull catamaran 110 is a carbon fiber catamaran with foam cored hulls. The catamaran 110 may have an overall length of forty feet (40 ft). The catamaran 110 is a high-performance catamaran with a top speed greater than fifty (50) knots. The catamaran 110 is powered by twin engines, such as twin YANMAR turbo diesel 370 engines that deliver more than 4500 lbs of thrust at a speed of twenty-five (25) knots. The catamaran 110 includes an opening between the hulls configured to accept the payload module 120.

The payload module 120 is a removable, mission-configurable pod that is disposed in the opening between the hulls of the catamaran 110, somewhat aft of center. Once positioned in the opening, the payload module 120 may be mounted to the structural frame of the catamaran 110. The payload module 120 is configurable for a wide variety of military and non-military missions, including mine warfare, anti-submarine warfare, unmanned oil field inspections, and harbor patrols and surveys.

In an embodiment, the large payload module 120 is a substantially rectangular prism having overall dimensions of approximately twenty feet long×six feet wide×four feet high (20 ft L×6 ft W×4 ft H). However, each of the dimensions may be smaller and compartmentalized for multiple mission packages or larger as required for particular applications. In some embodiments, the sides of payload module 120 may include a beveled portion, as shown in greater detail in FIG. 2A. The mission modules can be transported in standard ISO shipping containers for maximum flexibility.

The payload module 120 is configured with a common interface (not shown) connecting the payload module 120 to the catamaran 110. The common interface allows the sharing of utilities (e.g., power, data, hydraulics, air, etc.) and other supplies between the catamaran 110 and the payload module 120. The common interface supports mission flexibility.

Figure 2A:
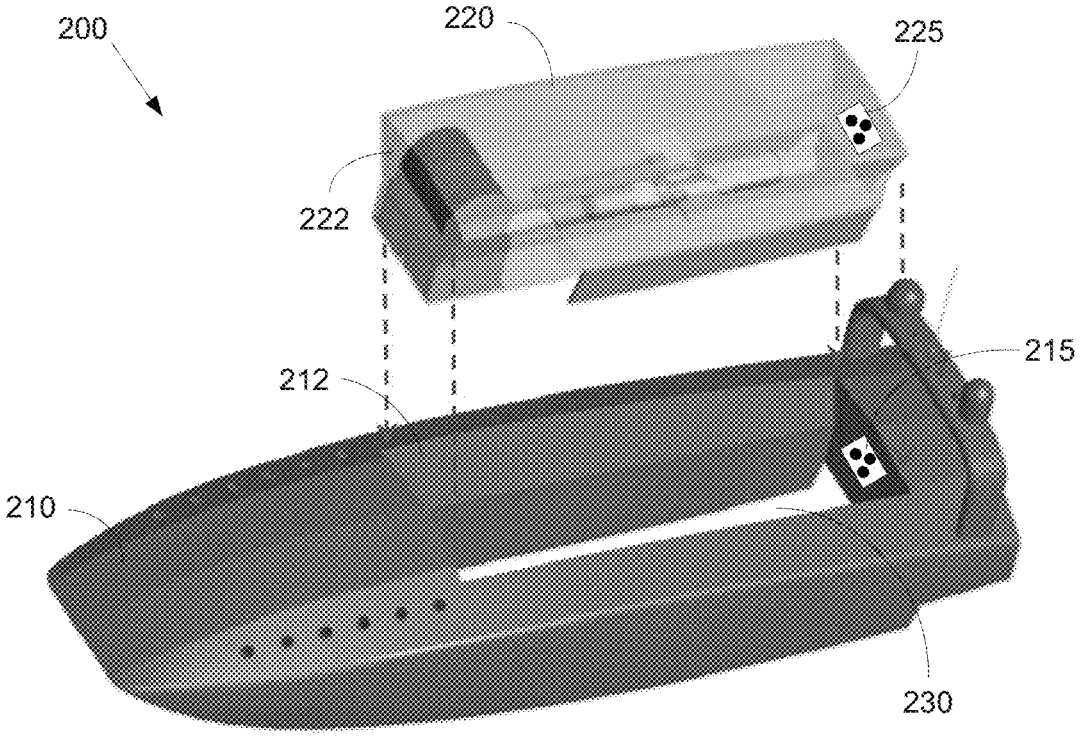
FIGS. 2A and 2B illustrate placement of the removable payload module in the USV, according to an embodiment of this disclosure.
Figure 2B:
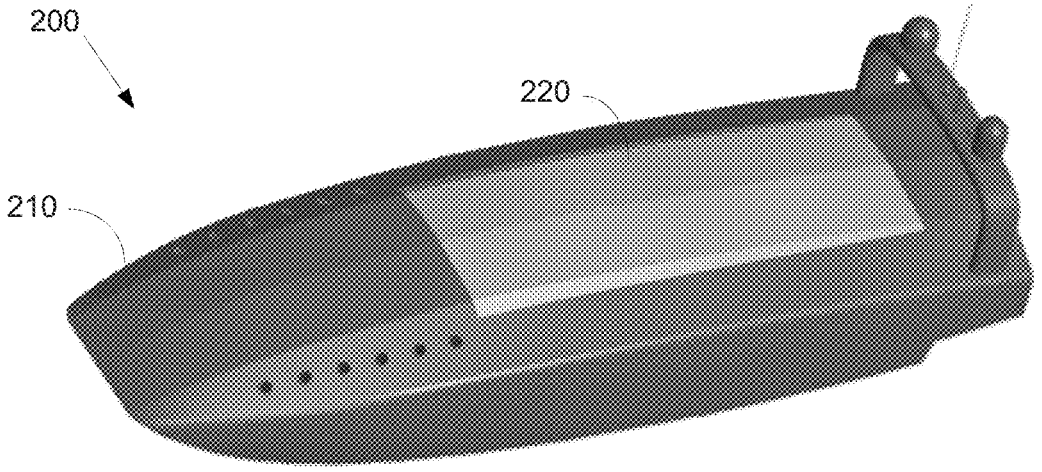

FIGS. 2A and 2B illustrate placement of the removable payload module in the USV, according to an embodiment of this disclosure. The embodiment of the USV 200 illustrated in FIGS. 2A and 2B is for illustration only. Other embodiments could be used without departing from the scope of this disclosure.

The USV 200 includes a twin hull catamaran 210 and the removable payload module 220. The USV 200 may be the same as or similar to the USV 100 in FIG. 1. The catamaran 210 includes an opening 230 between the twin hulls into which the payload module 220 may be positioned, as shown in FIG. 2B. The opening 230 has a size and shape substantially the same as the payload module 220, as shown in FIG. 2A. The opening 230 passes completely through a vertical cross-section of the catamaran 210. Thus, the payload module 220 may be loaded into the catamaran 210 from above, and may be dropped or lowered from the catamaran 210 into the water. Vibration mounts in each corner of the payload module 220 or the opening 230 serve to protect the payload module 220 and its contents from shock. In some embodiments, additional vibration mounts positioned away from the corners may be included (e.g., 6-8 mounts total). The internal configuration of the module may be designed to support specific hardware while maintaining the performance of the catamaran USV.

The payload module 220 may have an overall shape of a substantially rectangular prism. In some embodiments, one or more sides of the rectangular payload module 220 may have a beveled portion 222. Each beveled portion 222 of the payload module 220 may correspond to a beveled wall 212 on the catamaran 210 that partially defines the opening 230.

As shown in FIG. 2A, the opening 230 (and thus the placement of the payload module 220 in the catamaran 210) is somewhat aft of the center of the catamaran 210. This placement is determined in part to provide an actively controlled tow point in the payload module 220 that optimizes the tow characteristics of the catamaran 210 in any condition (e.g., speed, weight, sea condition). In different embodiments, the placement of the opening 230 could be located further fore or aft between the hulls, depending on needs. The placement of the opening 230 between the hulls provides stability while the payload module 220 is being installed in the catamaran 210, and allows the payload module 220 or its contents to be lowered into the water without interference by (or interference to) the hulls.

The payload module 220 includes an interface connection point 225 that connects to an interface connection point 215 on the catamaran 210. The connection points 215, 225 provide a single common interface connecting the payload module 220 to the catamaran 210. The common interface allows the sharing of utilities (e.g., power, data, hydraulics, air, etc.) and other supplies between the catamaran 210 and the payload module 220. The connection points 215, 225 feature quick connections for rapid payload switch in a "plug & play" fashion. Utilities required for a wide variety of cargo types (e.g., a gun system, radar system, tracking system, missile launching system, etc.) can be easily provided by simply coupling the connection points 215, 225 of the common interface. Thus, the common interface supports mission flexibility.

The payload module 220 is configured to be swapped quickly and easily with another payload module in order to configure the USV 200 for a different mission. First, the connection points 215, 225 of the common interface are disconnected. Then, the payload module 220 is simply lifted from the catamaran 210 (e.g., using a crane), and a new payload module adapted for a different mission is lowered into the catamaran 210. Finally, the common interface connection points of the new payload module and the catamaran 210 are connected. The USV 200 is thereby quickly configured for a different mission.

Figure 3A:
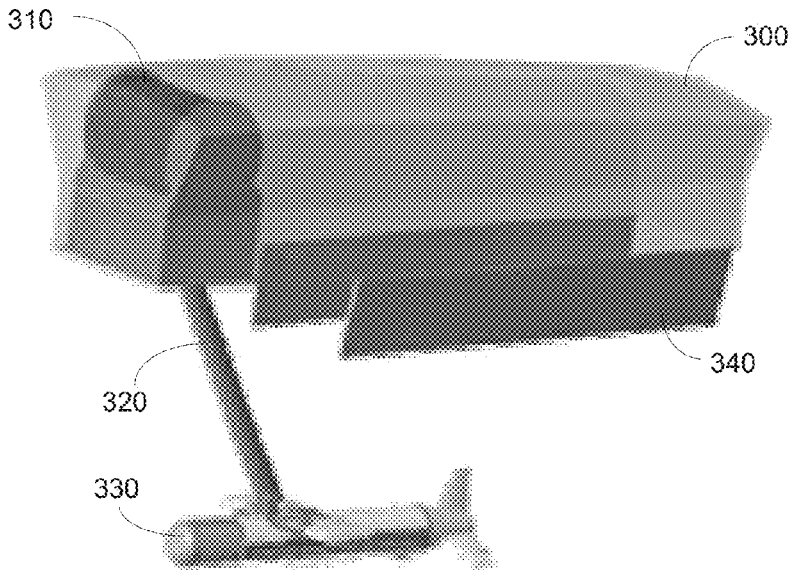
FIGS. 3A and 3B illustrate a removable payload module configured for an active tow wing system, according to an embodiment of this disclosure.
Figure 3B:
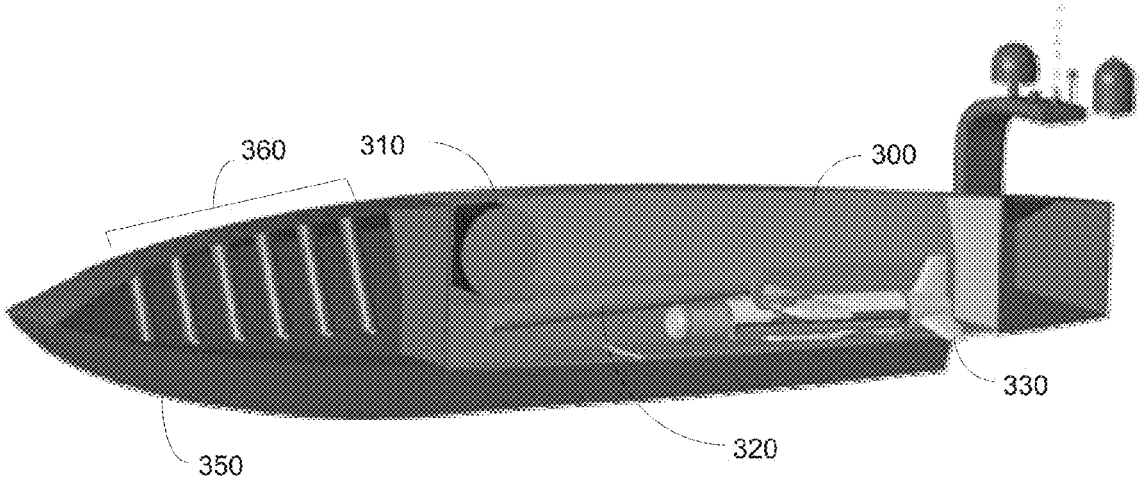

FIGS. 3A and 3B illustrate a removable payload module configured for an active tow wing system, according to an embodiment of this disclosure. The embodiment illustrated in FIGS. 3A and 3B is for illustration only. Other embodiments could be used without departing from the scope of this disclosure.

As shown in FIG. 3A, the payload module 300 houses a tow cable coiled around a winch 310. The end of the tow cable is connected to a stabilizer bar 320, which is in turn hinged to a mine hunting sonar system 330. The payload module 300 also includes payload doors 340 located on a bottom surface of the payload module 300. As shown in FIG. 3B, the payload module 300 can be installed in a catamaran 350. Upon deployment, the payload doors 340 are opened (as shown in FIG. 3A), and the stabilizer bar 320 and sonar system 330 are lowered into the water between the hulls of the catamaran 350 as the tow cable is uncoiled from the winch 310. The depth of the deployed sonar system 330 in the water is adjusted by coiling or uncoiling cable at the wench 310. Power and control commands to operate the winch 310 and the sonar system 330 are transmitted from the catamaran 350 to the payload module 300 through a common interface, such as the common interface described in FIGS. 2A and 2B. Likewise, feedback information and sonar results from the wench 310 and the sonar system 330 may be transmitted to the catamaran 350 through the common interface.

When the mine hunting sonar system 330 is not deployed (as shown in FIG. 3B), the sonar system 330 is stored within the payload module 300. The payload doors 340 close up the interior cavity of the payload module 300, creating a substantially water resistant cavity. Any water that may get in the cavity while the doors are open may be drained out through one or more drain holes in the floor of the payload module 300.

In some embodiments, the catamaran 350 includes a plurality of sonobuoy launch tubes 360.

Figure 4:
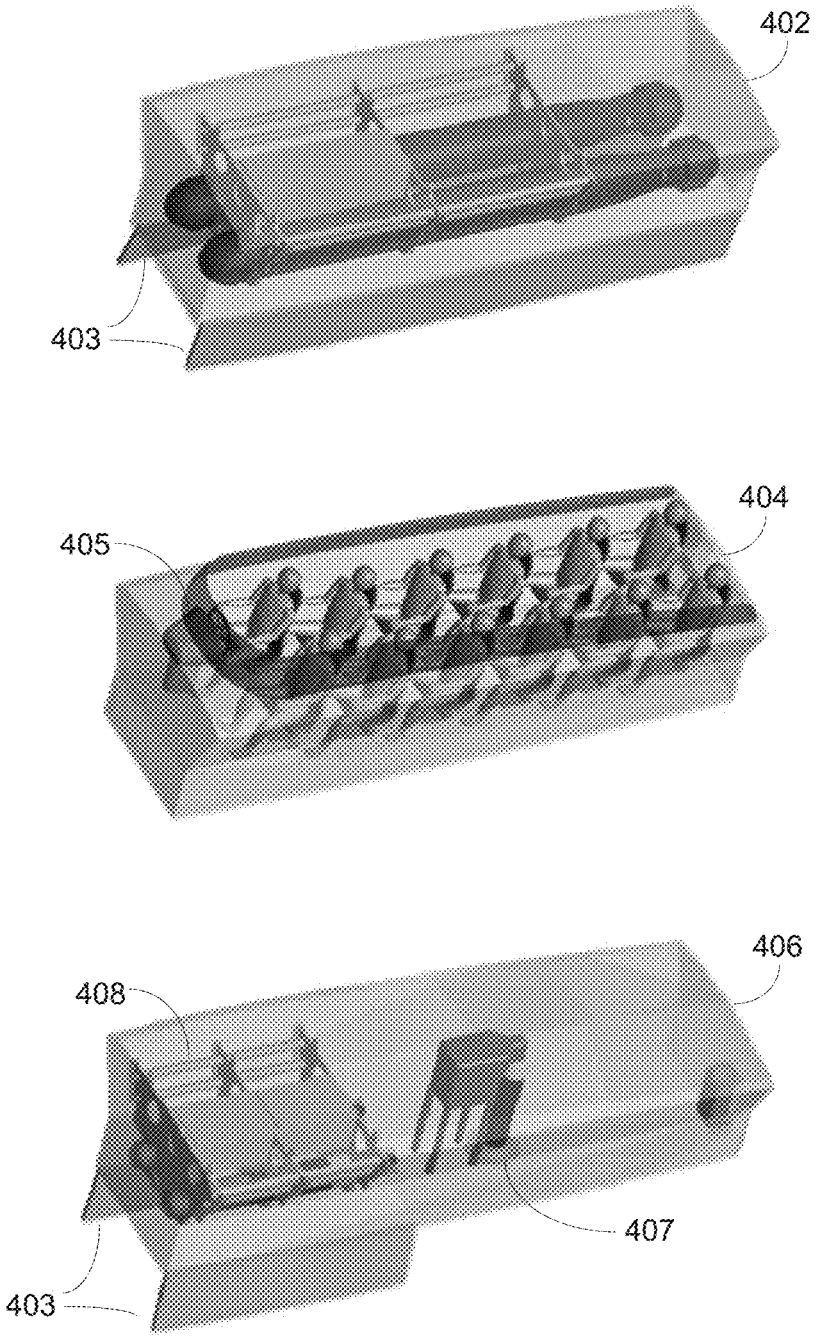
FIG. 4 illustrates a number of different removable payload modules configured for different missions, according to embodiments of this disclosure.

FIG. 4 illustrates a number of different removable payload modules configured for different missions, according to embodiments of this disclosure. The embodiments of the removable payload modules illustrated in FIG. 4 are for illustration only. Other embodiments could be used without departing from the scope of this disclosure.

Similar to module 220, modules 402, 404, 406 are configured to be removably disposed within a catamaran, such as catamaran 210. Each of the modules 402, 404, 406 is equipped differently for different missions. The modules may be installed, removed, and swapped as needed while at sea to fulfill complex missions. Utilities, commands, and feedback information may be transmitted between the catamaran and each of the different modules 402, 404, 406 via a common interface, such as the common interface described in FIGS. 2A and 2B.

Module 402 is configured to carry one or more torpedoes or surface mine countermeasure (SMCM) unmanned undersea vehicles (UUVs), such as MK48 torpedoes. Module 402 includes bottom payload doors 403 to allow the payload to be lowered or dropped into the water.

Module 404 is configured to house a team of personnel (e.g., Navy SEALs) for a manned operation or mission. In such a mission, the catamaran is no longer an unmanned surface vehicle (USV), but instead becomes a manned surface vehicle. The module 404 may be equipped with seats arranged in rows for the personnel. A command or navigation position 405 allows one or more personnel to operate, control, and navigate the manned catamaran from within the module 404.

Module 406 is configured with an advanced low frequency sonar (ALES) unit 407 and a plurality of MK54 lightweight torpedoes 408. Bottom payload doors 403 allow the torpedoes 408 to be lowered or dropped into the water.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

Modifications, additions, or omissions may be made to the systems, apparatuses, and methods described herein without departing from the scope of the invention. The components of the systems and apparatuses may be integrated or separated. Moreover, the operations of the systems and apparatuses may be performed by more, fewer, or other components. The methods may include more, fewer, or other steps. Additionally, steps may be performed in any suitable order. As used in this document, "each" refers to each member of a set or each member of a subset of a set.

What is claimed is:

1. A system comprising:

a catamaran configured for use in a body of water and having twin hulls, the catamaran comprising a vertically-oriented opening between the twin hulls;

a payload module removably coupled to the catamaran in the opening between the twin hulls, the opening having a size and shape substantially the same as the payload module; and a common interface removably coupled to the payload module and the catamaran, the common interface configured to exchange utilities between the payload module and the catamaran, wherein the opening (i) allows the payload module to be vertically lowered from a position above the catamaran into the opening and (ii) allows at least one of the payload module or a payload in the payload module to be lowered into the water after the payload module is coupled to the catamaran in the opening.

2. The system of claim 1, wherein the payload module comprises at least one door on a bottom surface, the at least one door configured when opened to allow the lowering of the payload in the payload module down between the twin hulls of the catamaran.

3. The system of claim 1, wherein the opening allows the payload module to be lowered from the catamaran between the twin hulls into the water.

4. The system of claim 1, wherein the payload module comprises a first payload module, the system further comprising a second payload module having an overall size and shape substantially the same as the first payload module, the second payload module configured to house a different type of payload than the first payload module.

5. The system of claim 1, wherein the utilities comprise at least two of power, data, air, hydraulics and fuel.

6. The system of claim 1, wherein the payload module comprises a winch and cable configured to reel out the payload into the water through an opening on a bottom surface of the payload module, tow the payload in the water, and reel in the payload back into the payload module.

7. The system of claim 1, wherein the twin hulls of the catamaran are comprised of carbon fiber surrounding a foam core.

8. The system of claim 1, wherein the payload module comprises a command unit configured to control the catamaran.

9. A system comprising:

a catamaran configured for use in a body of water and having twin hulls, the catamaran comprising a vertically-oriented opening between the twin hulls;

a first payload module removably installed in the opening between the twin hulls, the first payload module having a size and shape substantially the same as the opening;

a second payload module having a size and shape substantially the same as the opening, the second payload module configured to be installed in the opening between the twin hulls during a time period when the first payload module is removed from the opening; and a connection point on the catamaran for a common interface that is configured to couple to a second connection point for the common interface on the first payload module or the second payload module, the common interface configured to exchange utilities between either payload module and the catamaran, wherein the opening (i) allows the first or second payload module to be vertically lowered from a position above the catamaran into the opening and (ii) allows a payload stored in either payload module to be lowered through the opening into the body of water after either payload module is coupled to the catamaran in the opening.

10. The system of claim 9, wherein the first payload module comprises at least one door on a bottom surface, the at least one door configured when opened to allow the lowering of the payload in the payload module down between the twin hulls of the catamaran.

11. The system of claim 9, wherein the opening allows either payload module to be lowered from the catamaran between the twin hulls into the water.

12. The system of claim 9, wherein the utilities comprise at least two of power, data, air, hydraulics and fuel.

13. The system of claim 9, wherein the first payload module comprises a winch and cable configured to reel out the payload into the water through an opening on a bottom surface of the first payload module, tow the payload in the water, and reel in the payload back into the first payload module.

14. The system of claim 9, further comprising a command unit configured to control the catamaran.

15. A method comprising:

vertically lowering a payload module from a position above a catamaran into a vertically-oriented opening in the catamaran;

coupling the payload module to the opening in the catamaran;

coupling a first connection point for a common interface on the payload module to a second connection point for the common interface on the catamaran, the common interface configured to exchange utilities between the payload module and the catamaran; and lowering a payload from the payload module into a body of water in which the catamaran is positioned, wherein the catamaran has twin hulls, the opening is located between the twin hulls, and the opening has a size and shape substantially the same as the payload module.

16. The method of claim 15, wherein the payload module comprises at least one door on a bottom surface, the method further comprising:

opening the at least one door before lowering the payload from the payload module down between the twin hulls of the catamaran.

17. The method of claim 15, further comprising lowering the payload module down from the catamaran between the twin hulls into the water.

18. The method of claim 15, wherein the payload module is a first payload module, the method further comprising:

unloading the first payload module from the opening in the catamaran; and loading a second payload module into the opening in the catamaran, the second payload module having an overall size and shape substantially the same as the first payload module, the second payload module configured to house a different type of payload than the first payload module.

19. The method of claim 15, wherein the utilities comprise at least two of power, data, air, hydraulics and fuel.

20. The method of claim 15, wherein the payload module comprises a winch and cable configured to reel out the payload into the water through an opening on a bottom surface of the payload module, tow the payload in the water, and reel in the payload back into the payload module.

* * * * *